US005285737A

United States Patent [19]

Chen

[11] Patent Number: 5,285,737

[45] Date of Patent: Feb. 15, 1994

[54] INCINERATOR

[75] Inventor: Hong-Jen Chen, Min Hsiung Hsiang, Taiwan

[73] Assignee: Tsai-Hsia Chen, Chia I, Taiwan

[21] Appl. No.: 924,917

[22] Filed: Aug. 5, 1992

[51] Int. Cl.[5] ..... F23B 5/00

[52] U.S. Cl. ..... 110/214; 110/215; 110/234; 110/170

[58] Field of Search ..... 110/215, 233, 234, 242, 110/248

[56] References Cited

U.S. PATENT DOCUMENTS

| | | | |
|---|---|---|---|
| 4,351,248 | 9/1982 | Viessmann | 110/170 |
| 4,976,208 | 12/1990 | O'Connor | 110/247 |
| 4,999,167 | 3/1991 | Skelley et al. | 110/215 |
| 5,138,957 | 8/1992 | Morey et al. | 110/214 |
| 5,165,350 | 11/1992 | Leffel | 110/234 |

*Primary Examiner*—Henry C. Yuen

*Attorney, Agent, or Firm*—Morton J. Rosenberg; David I. Klein

[57] ABSTRACT

An has included a furnace, a blower at one side of the furnace, a fuel supply means, a wind guiding means, a filter means, a broiling chamber, and a dust expelling means. The furnace has a combustion chamber at inner bottom portion adapted to burn trash therein by lighting a fire on the trash through the fuel supply means. Ashes results from burning trash are cleaned through a door on the broiling chamber. Waste gas results from burning trash is expelled through the filter means whereas most particles of the smoke are falling on the bottom of the furnace and only a few amount of particles and the Carbone Monoxide are expelled through exhaust fan of the filter means.

3 Claims, 4 Drawing Sheets

INCINERATOR

FIELD OF THE INVENTION

This invention relates to an incinerator. More particularly, an incinerator to burn flammable garbages within a sealed furnace to protect environment.

BACKGROUND OF RELATED ART

The incinerators have been displayed on the market and been used for a certain time for burn out garbages. However, the fuel that incinerators are used are heavy oil which not only expensive but also resulting air pollution.

The inventor, in view of this, has invented a renovated incinerator which correct all the forgoing shortcomings.

SUMMARY OF THE INVENTION

It is the primary object of the present invention to provide an incinerator which is able to burn trashes entirely.

It is another object of the present invention to provide an incinerator which filters waste gas before it is expelled.

It is a still another object of the present invention to provide an incinerator which utilizes the heat from burning waste as hot water resource and therefore complies with the principle of cost effectiveness.

It is a further object of the present invention to provide an incinerator which is easy to clean waster dust.

It is still a further object of the present invention to provide an incinerator which is easy to operate.

DETAILED OF THE PREFERRED EMBODIMENT

Figure 1:
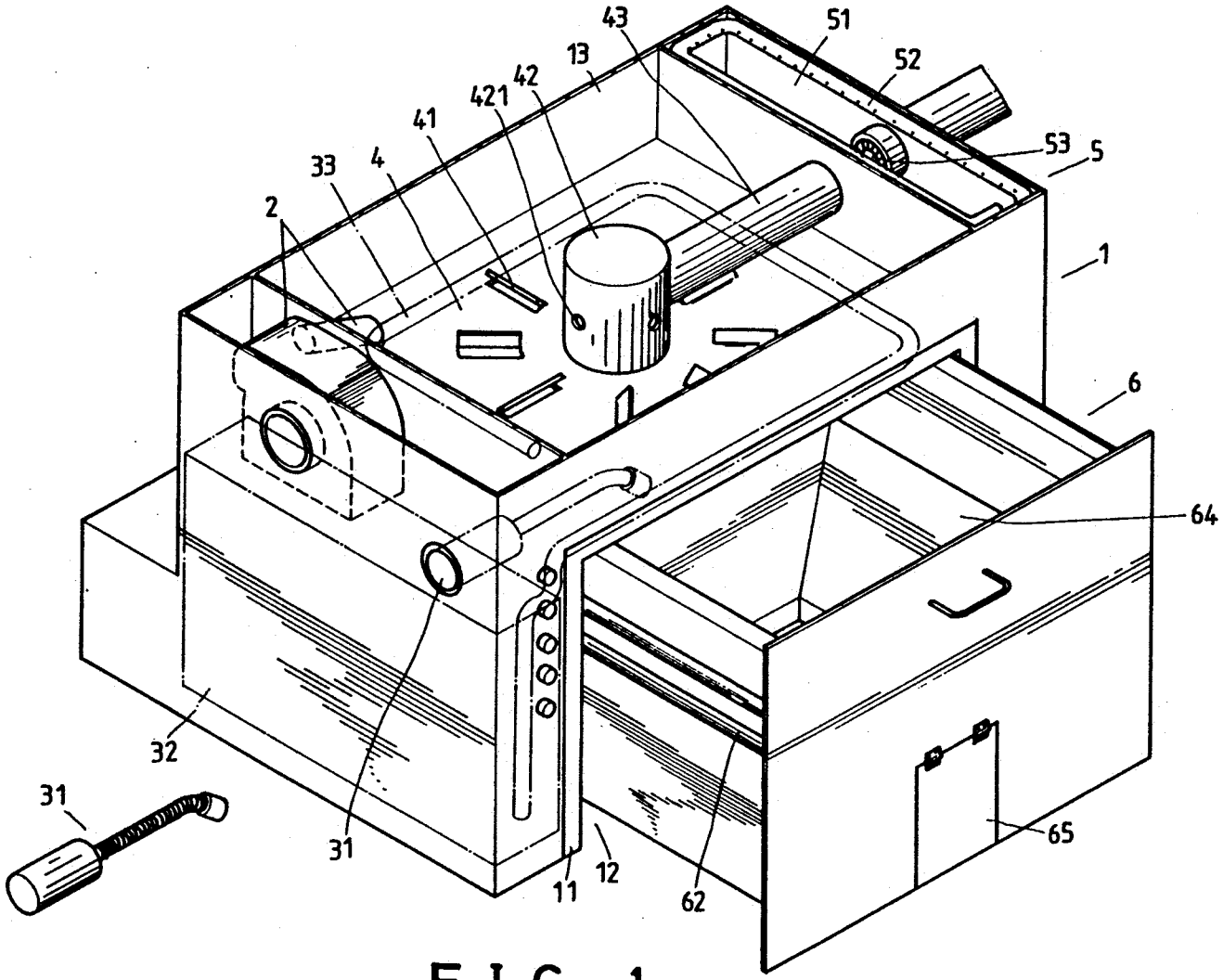
FIG. 1 is a perspective view of the present invention.
Figure 2:
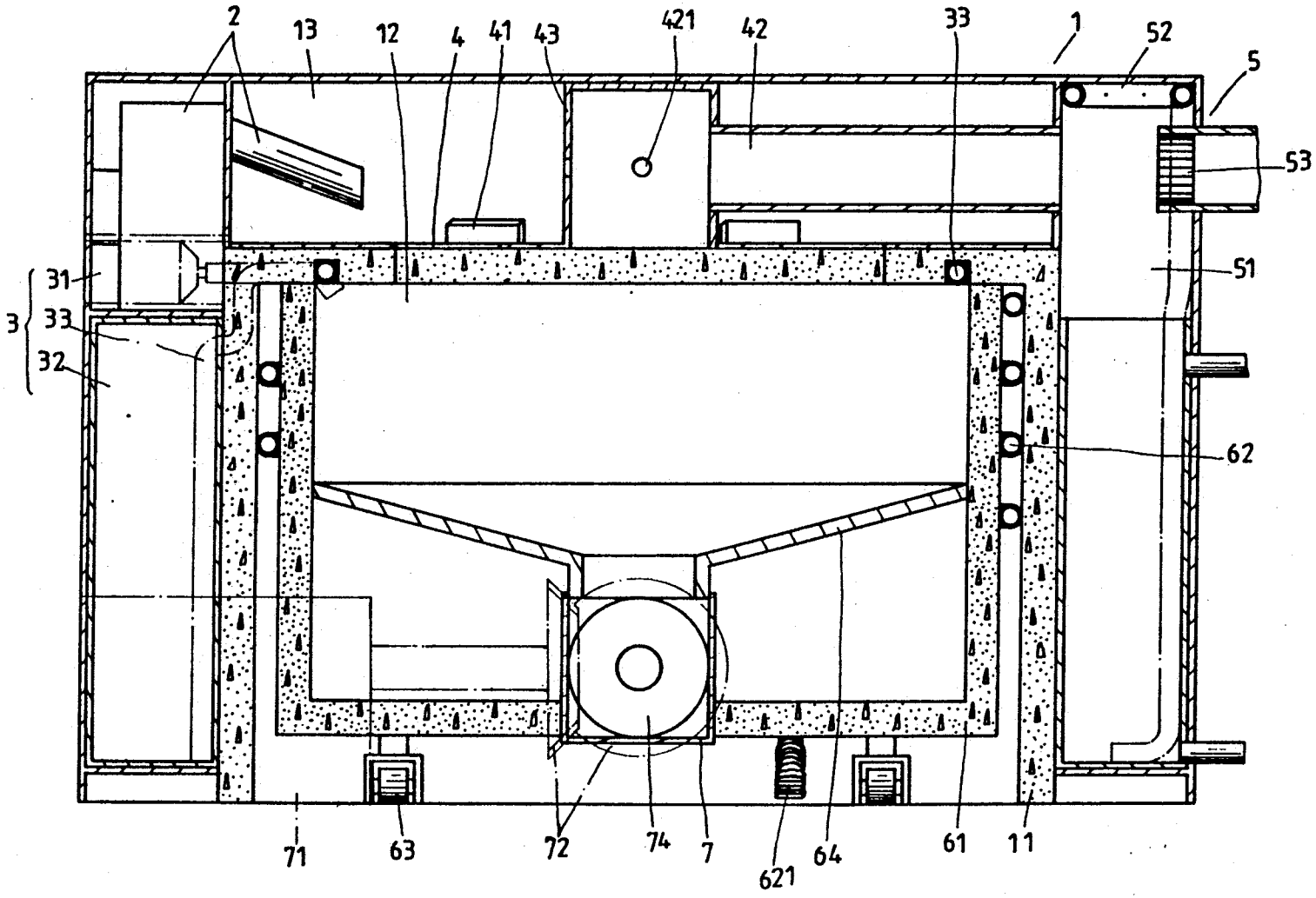
FIG. 2 is a side elevational view of FIG. 1, partially sectioned.

Reference is firstly made to FIGS. 1 and 2 of the present invention which comprises a furnace 1, a blower 2, a fuel supply mean 3, a wind guiding mean 4, a filter means 5, a broiling chamber 6 and a dust expelling means 7.

The furnace 1 includes a combustion chamber 12 shaped like a reversed English letter 'U', preferrably formed from heat-resistant bricks 11, an empty room 13 adapted as wind chamber collecting wind blows from the blower 2.

The fuel supply means 3 is composed of lighting means 31 adapted to light a fire to the trash in the furnace 1, a fuel tank 32, and a fuel pipe 33 surrounding the inner top portion of the furnace 1 having a plurality of discharge ports thereon adapted to eject fuel into the broiling chamber 6.

The wind guiding means 4 has a plurality of guide blades 41 adapted to guide air blowing from the blower 2 into the combustion chamber 12 to assist flame, a smoke outlet 42 at one side connected to a pipe 43 being adapted to expel smoke results from burning trash, a plurality of apertures 421 on the side wall of the smoke outlet 42 adapted to such air therein to thin the smoke by sucking air into the smoke outlet 42 from the guiding means 42.

The filter means 5 is generally composed of a sprinkle area 51 having a number of water pipes 52 adapted to sprinkle water on waste gas, whereas larger particles of the waste gas will be washed out and only small particles come out from an exhaust fan 53 at outer portion of the furnace 1.

The broiling chamber 6 shaped like a drawer being constructed by heat-resistant bricks 61 with an opening at its top portion to receive ashes from the combustion chamber 12. A number of hot water pipes 62 are fixedly arranged around the chamber 6 adapted to utilize the heat to boil water for other purposes. A number of wheels 63 are adapted to move the broiling chamber 6 in and out. At outer portion of the broiling chamber 6 a door 65 is adapted so as to clean the chamber 6.

Figure 3A:
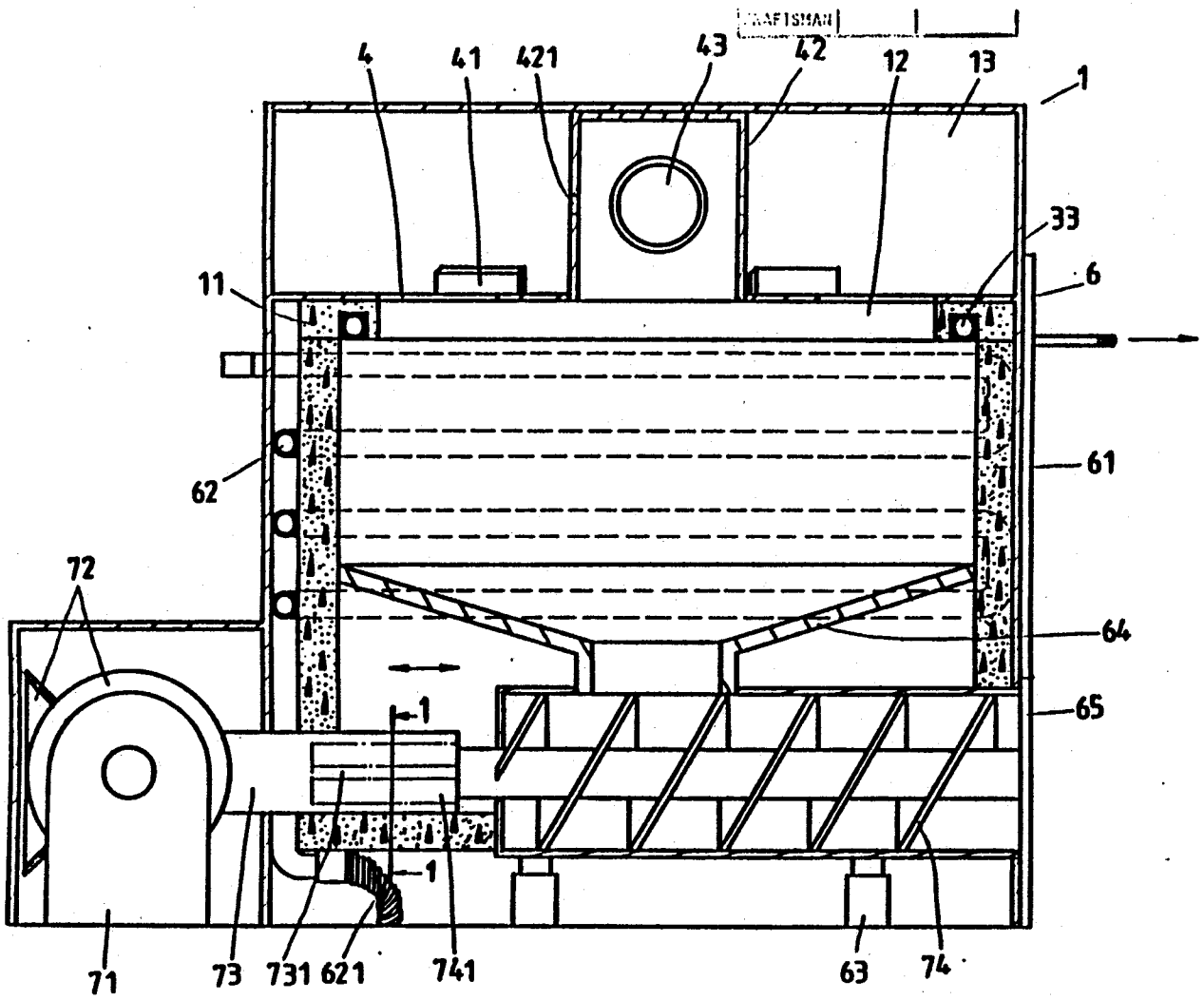
FIG. 3A is a front view of the FIG. 1, partially sectioned.
Figure 3B:
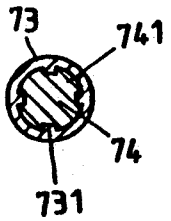
FIG. 3B is a cross-sectional view taken along the section lines 1—1 of FIG. 3A.

Now please refer to the FIGS. 3A and 3B, the dust expelling means 7 is composed of a motor 71, a gear train 72, an output shaft 73 having a socket 731 at one end, and a screw conveyer 74 having a socket 741 at one end and being sized so as to be received within the socket 731 in a telescopic fashion when the broiling chamber 6 is sliding in or out.

Figure 4:
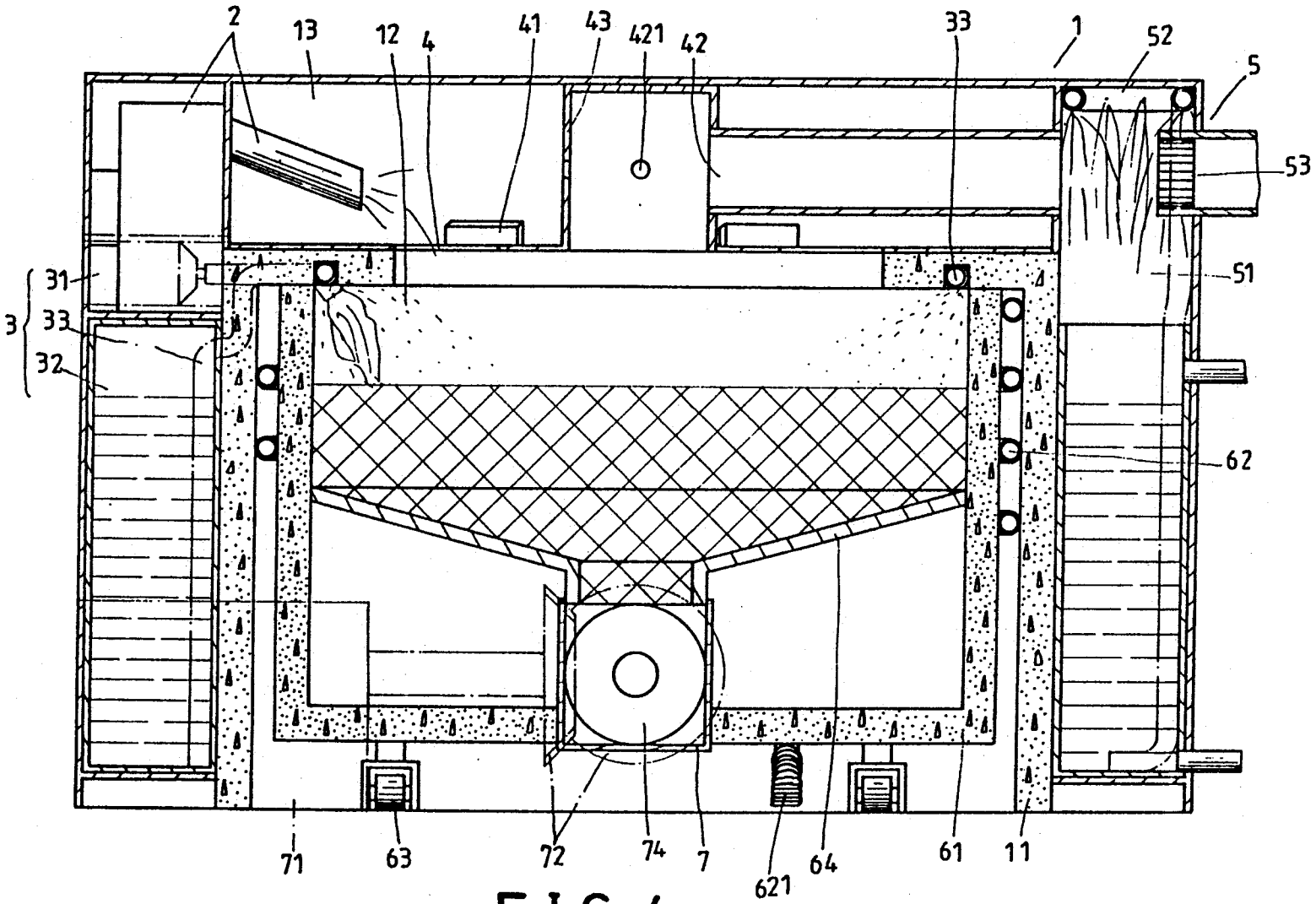
FIG. 4 is the side elevational view of FIG. 2 showing an actual operation of the present invention.

In operation, upon filling with trash, as shown in FIG. 4, the broiling chamber 6 is pushed into the combustion chamber 12. Speading fuel onto trash through discharge ports evenly, light a fire with the lighting means 31, and blow air into the chamber 12 through the blower 2 to assist the flame. The smoke come from burning will raise from the center portion and expelled through the pipe 43, the sprinkle area 51 and expelled through the exhaust fan 53. Most of the particles of the smoke will fall down to the bottom with the sprinkle water and only a few of the particles and Carbon Monoxide will come out. The apertures 421 will further thin the smoke to minize the smoke to be expelled through the fan 53. In such a manner, upon trash is burned throughly and cooled down, the motor 71 is activated to move the screw conveyer 74 outwardly and ashes may be collect through the door 6. In the meantime, the heat results from burning trash will boil the water in the hot water pipe 62 to act as energy saver.

I claim:

1. An incinerator for combusting waste material comprising:

a furnace housing having a combustion chamber, said furnace housing an air receiving chamber formed in a top portion thereof adapted to collect air being inserted from a blower;

fuel supply means located internal said furnace housing for transport of fuel and ignition of said waste material, said fuel supply means including ignition means adapted to ignite said waste material, a fuel tank, and a fuel delivery pipe surrounding the inner top portion of said combustion chamber having a plurality of discharge ports adapted to spread fuel on said waste material;

air guiding means positioned in said air receiving chamber having a plurality of guide blades for directing air into said combustion chamber, a smoke outlet mounted above said combustion chamber and connected to a smoke removal pipe adapted to expel smoke external said incinerator, a plurality of apertures are formed through a side wall of said outlet adapted to suck air therein to thin the smoke from the ignited waste material;

filter means in fluid communication with said outlet having a sprinkle area including a plurality of water pipes adapted to sprinkle water on waste gas resulting from burning said waste material and for filtering larger particles contained in the smoke;

a broiling chamber formed within said furnace housing preferably formed from heat-resistant bricks having an opening at a top portion thereof adapted to receive ashes from said combustion chamber, a plurality of hot water pipes secured around said broiling chamber adapted to utilize the heat from said burning waste material to boil water within said hot water pipes, a plurality of wheel coupled to a lower portion of said broiling chamber to assist moving thereof at least partially external said furnace housing to clean said broiling chamber; and dust expelling means mounted in a lower section of said furnace housing having a motor, a gear train, an output shaft, and a screw conveyor for removing dust from internal said furnace housing;

2. An incinerator of claim 1, wherein said furnace housing is arch shaped being preferably formed from heat-resistant bricks.

3. An incinerator of claim 1, wherein said output shaft of said dust expelling means has a first socket secured to one end thereof, said screw conveyer having a second socket at one end thereof and being sized to be received in said first socket of said output shaft in a telescopic manner to adjust the length of said output shaft.

* * * * *